United States Patent [19]

Dunnette

[11] 4,006,657

[45] Feb. 8, 1977

[54] STRINGED MUSICAL INSTRUMENTS

[76] Inventor: Harry Dunnette, 953 Fraser Drive, Burlington, Ontario, Canada

[22] Filed: Jan. 2, 1976

[21] Appl. No.: 646,002

[52] U.S. Cl. ..... 84/314; 84/297 R; 84/304

[51] Int. Cl.[2] ..... G10D 3/06; G10D 3/14

[58] Field of Search ..... 84/314, 304, 305, 297 R, 84/267, 268, 269

[56] References Cited

UNITED STATES PATENTS

| | | | |
|---|---|---|---|
| 1,713,002 | 5/1929 | Oettinger | 84/304 |
| 2,771,808 | 11/1956 | Jenkins, Jr. | 84/304 |
| 3,191,480 | 6/1965 | Lowe | 84/314 |
| 3,461,768 | 8/1969 | Ultes, Jr. | 84/304 |

*Primary Examiner*—Stephen J. Tomsky
*Attorney, Agent, or Firm*—Hirons & Rogers

[57] ABSTRACT

A stringed musical instrument particularly a ukelele employing simple rotatable friction pegs in the machine head, is provided with a tension-receiving member for the strings disposed between the instrument nut and the machine head. Each string is looped in a circle about the member and it is found there is a marked reduction in the tendency for the instrument to detune under the string tension. The member may be constituted by a screw or a rod mounted by the instrument neck and about which the respective string is looped. With a wooden-necked instrument each member may be constituted by a wood screw screwed directly into the neck.

5 Claims, 4 Drawing Figures

STRINGED MUSICAL INSTRUMENTS

FIELD OF THE INVENTION

The present invention is concerned with improvements in or relating to stringed musical instruments, and especially but not exclusively to ukeleles.

REVIEW OF THE PRIOR ART

The construction of stringed musical instruments is now well-established, each string being stretched between a fixed anchor point and an adjustable machine head by which the string tension is adjusted. The intervening stretched portion of the string passes over a "bridge"at the resonator end and a "nut"at the other end, the distance between the bridge and the nut determining the effective length of the string.

The ukelele is a particular example of a four-stringed instrument that has continued in popularity because of its relative simplicity of construction and of playing. Nevertheless, it is a full-fledged musical instrument and can be used for the teaching of music; because of this fact, plus its low cost and the fact that the player can also sing the song being played, the instrument has become popular for schools.

It is essential therefore to keep the cost as low as possible, and this dictates the use of simple friction pegs in the machine head for tuning, instead of the more expensive worm and pinion arrangements that could otherwise be used. Friction pegs have the disadvantage that they slip readily under the string tension, and it is common for an inexpensive ukelele to become "detuned" or go out of tune in a period as short as a day or two.

DEFINITION OF THE INVENTION

It is therefore an object of the invention to provide a stringing arrangement for stringed musical instrument which alleviates the problem of detuning due to slip in the machine head.

It is a more specific object to provide a stringing arrangement for a ukelele using simple friction pegs in the machine head which alleviates the problem of detuning due to slip in the machine head.

In accordance with the present invention there is provided in a stringed musical instrument having at least one string a tension-receiving member for each string disposed between the nut and the machine head and around which the said string forms a circular loop to reduce the tension thereof applied to the machine head.

In a necked instrument such as a ukelele and wherein the instrument neck is of wood, the machine head consists of a friction peg for each string, and each string has a respective tension-receiving member constituted by a threaded wood screw screwed into the wooden instrument neck to extend therefrom and around which the respective string is looped.

DESCRIPTION OF THE DRAWINGS

Particular preferred embodiments of the invention will now be described, by way of example, with reference to the accompanying diagrammatic drawings, wherein.

DESCRIPTION OF THE PREFERRED EMBODIMENTS

Figure 1:
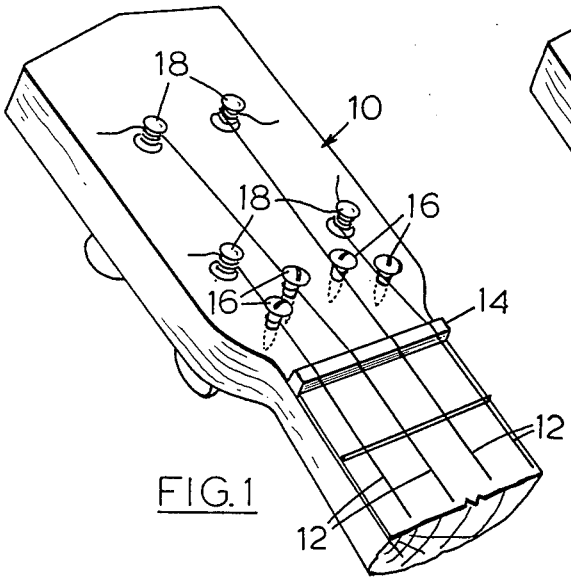
FIGS. 1 to 4 are respective similar perspective views of the different embodiments, in each case only the neck of the instrument being shown.

The first embodiment illustrated by FIG. 1 is a wooden-necked ukelele 10 provided with four strings 12, only the neck of the instrument being shown. The four strings pass over a common nut 14, and then are each looped to pass in a circular loop about a respective tension-receiving member 16 before passing to a respective friction peg 18 of the instrument machine head. In this embodiment each tension-receiving member is constituted by a wood screw which is screwed directly into the wooden neck to extend vertically therefrom, the looped string being wound upon a screw-threaded portion of the screw shank.

It is found that in even an inexpensive ukelele, employing simple friction-restrained pegs in the machine head for adjustment of the string tension, upon the provision of tension-receiving means in accordance with the invention the period for which the instrument remains in sufficient tune is increased dramatically from a period of a day or two to several weeks.

Figure 2:
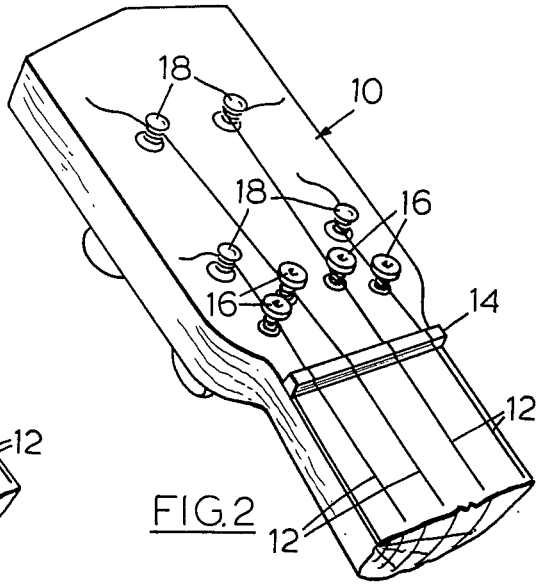
Figure 3:
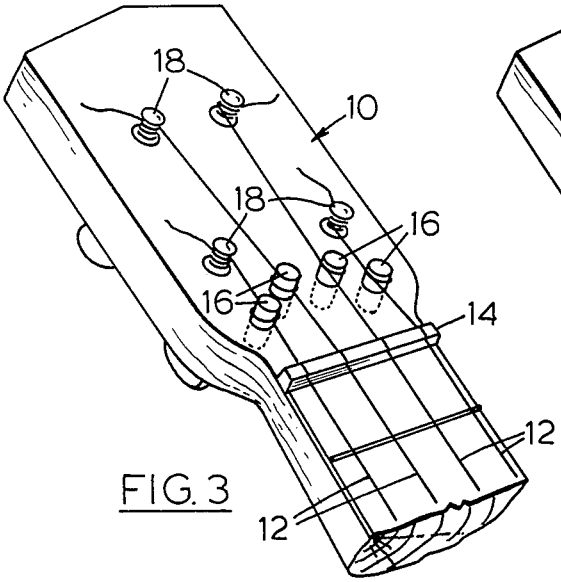

In the embodiment of FIG. 2 each tension-receiving member 16 is constituted by a machine screw threaded into a suitably prepared hole in the neck so as to extend vertically therefrom, while in the embodiment of FIG. 3 it is constituted by a plain rod secured (e.g. by glueing) in a respective hole.

Figure 4:
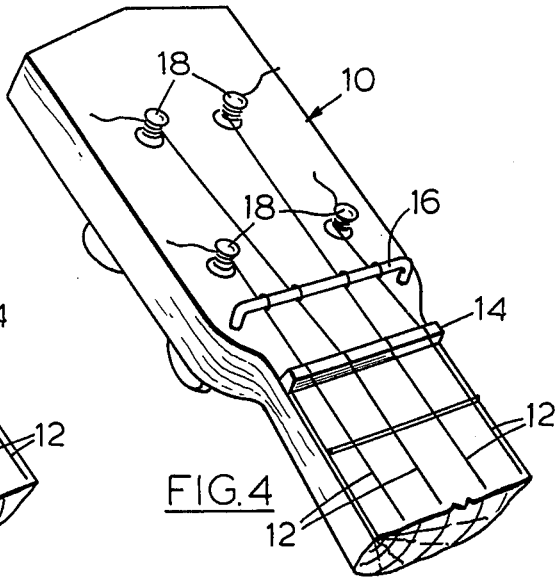

The members 16 need not extend vertically from the neck although this is the simplest arrangement and usually aesthetically the most pleasing. In the embodiment of FIG. 4 a single member 16 is provided common to all the strings and constituted by a single rod extending horizontally with bent-down ends fastened in holes in the neck.

I claim:

1. A stringed musical instrument comprising an instrument body, at least one string having its ends secured to the body, a nut on the body over which each string passes, a machine head on the body to which one end of each string is secured and for tensioning the string, and a tension receiving member disposed between the nut and the machine head and around which the string passes in a circular loop to reduce the tension thereof applied to the machine head.

2. An instrument as claimed in claim 1 and comprising a plurality of strings wherein each of the said strings is provided with a tension-receiving member around which the respective string forms a circular loop.

3. An instrument as claimed in claim 2, wherein the instrument body includes a neck on which the nut, the machine head and the tension-receiving members are mounted, and wherein each tension-receiving member is constituted by a post extending from the instrument neck and around which the respective string is looped.

4. An instrument as claimed in claim 2, wherein the instrument body includes a neck on which the nut, the machine head and the tension-receiving members are mounted, wherein the machine head consists of a friction peg for each string, and wherein each tension-receiving member is constituted by a threaded screw extending from the instrument neck and around which the respective string is looped.

5. An instrument as claimed in claim 2 wherein the instrument body includes a neck on which the nut, the machine head and the tension-receiving member are mounted, wherein the instrument neck is of wood, wherein the machine head consists bridge" a friction peg for each string, and nut" each tension-receiving member is constituted by a threaded wood screw screwed into the wooden instrument neck to extend therefrom and around which the respective string is looped.

* * * * *